US008887635B2

(12) United States Patent
Ehrhardt et al.

(10) Patent No.: US 8,887,635 B2
(45) Date of Patent: Nov. 18, 2014

(54) METHOD FOR CLEANING INKING UNITS IN OFFSET PRINTING PRESSES

(75) Inventors: Stephan Ehrhardt, Neulussheim (DE); Bernd Maier, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 67 days.

(21) Appl. No.: 13/462,293

(22) Filed: May 2, 2012

(65) Prior Publication Data

US 2012/0279408 A1 Nov. 8, 2012

(30) Foreign Application Priority Data

May 2, 2011 (DE) ..... 10 2011 100 288

(51) Int. Cl.
*B41F 33/00* (2006.01)
*B41F 35/04* (2006.01)

(52) U.S. Cl.
CPC ..... *B41F 35/04* (2013.01); *B41P 2235/21* (2013.01); *B41P 2235/26* (2013.01); *B41F 33/00* (2013.01)
USPC ..... 101/483; 101/423

(58) Field of Classification Search
USPC ..... 101/423, 483
See application file for complete search history.

(56) References Cited

U.S. PATENT DOCUMENTS 3,390,631 A * 7/1968 Koszul ..... 101/155
3,896,730 A * 7/1975 Garrett et al. ..... 101/425
4,942,813 A * 7/1990 Arai ..... 101/152
4,967,664 A * 11/1990 Iijima ..... 101/423
5,174,209 A * 12/1992 Rodi et al. ..... 101/424
5,367,982 A * 11/1994 DeMoore et al. ..... 118/46
5,584,245 A * 12/1996 Schonberg ..... 101/484
5,964,157 A * 10/1999 Hummel et al. ..... 101/483
6,047,640 A * 4/2000 Murakawa ..... 101/350.5
6,109,182 A 8/2000 Vestman et al.
6,576,059 B2 * 6/2003 Burgard ..... 118/683
6,615,725 B2 9/2003 Kurata et al.
6,915,742 B2 * 7/2005 Senoo et al. ..... 101/424
7,165,494 B2 * 1/2007 Shields ..... 101/483

(Continued)

FOREIGN PATENT DOCUMENTS

DE 10 2006 054 946 A1 5/2008
DE 601 29 633 T2 5/2008
DE 102007053489 A1 6/2008
EP 0 654 350 A1 5/1995

OTHER PUBLICATIONS

German Patent and Trademark Office Search Report, Dated October 18, 2011.

*Primary Examiner* — Anthony Nguyen
(74) *Attorney, Agent, or Firm* — Laurence A. Greenberg; Werner H. Stemer; Ralph E. Locher

(57) ABSTRACT

An offset printing press and a method for cleaning inking units in offset printing presses include emptying and subsequently refilling ink fountains of individual inking units of the printing units with ink sequentially one after the other. Immediately after the emptying of a first ink fountain, a washing operation for an associated inking unit is started even before remaining ink fountains have been emptied. After a respective further one of the remaining ink fountains has been emptied, the washing operation for a respective further inking unit is started and refilling of the first ink fountain is started while washing operations for one or more of the further inking units are still running.

5 Claims, 3 Drawing Sheets

(56) References Cited

U.S. PATENT DOCUMENTS

| | | | | |
|---|---|---|---|---|
| 7,373,882 | B2 | 5/2008 | Heuschkel et al. | |
| 7,533,609 | B2 | 5/2009 | Harzbecker | |
| 7,677,174 | B2 | 3/2010 | Eckel et al. | |
| 8,015,918 | B2 * | 9/2011 | Saito et al. | 101/425 |
| 8,033,219 | B2 | 10/2011 | Pasuch et al. | |
| 8,056,476 | B2 | 11/2011 | Sitzmann et al. | |
| 2001/0042482 | A1 | 11/2001 | Kurata et al. | |
| 2002/0096072 | A1 * | 7/2002 | Fujimoto et al. | 101/367 |

* cited by examiner

METHOD FOR CLEANING INKING UNITS IN OFFSET PRINTING PRESSES

CROSS-REFERENCE TO RELATED APPLICATION

This application claims the priority, under 35 U.S.C. §119, of German Patent Application DE 10 2011 100 288.3, filed May 2, 2011; the prior application is herewith incorporated by reference in its entirety.

BACKGROUND OF THE INVENTION

1. Field of the Invention:

Offset printing presses, including web-fed presses, in which a web of paper is printed, and sheet-fed printing presses, through which individual sheets are conveyed to be printed in colors on one side or on both sides, include multiple printing units. Each printing unit includes an inking unit, and each inking unit includes an ink fountain extending over a width of a printing format. The ink fountain is in contact with an ink fountain roller, which takes up the ink to be applied from the ink fountain and conveys it to further rollers of the inking unit. If the printing press includes a so-called short inking unit, anilox ink that it uses is contained in a chambered doctor blade, which is in engagement with a screen roller that functions similarly to the ink fountain roller.

From print job to print job, it may be necessary to change the ink in the respective inking unit and in the respective ink fountain. Such a necessity may arise because the next job is printed with a different set of inks or because the properties of the ink no longer meet the requirements, for instance in terms of its degree of contamination or the like. In general, a job change consequently requires the ink fountains to be emptied and the entire inking unit, the blanket on the blanket cylinder and the impression cylinder, i.e. all of the parts that received ink during the printing operation, to be washed.

Washing devices for lithographic offset printing presses are described, for instance, in the following documents: U.S. Pat. Nos. 8,056,476 B2, 8,033,219 B2, 7,677,174 B2, 7,533,609 B2 and 7,373,882 B2.

Such a job change thus incurs considerable down-time of the machine. That is not exclusively due to the cleaning operations, but they significantly contribute to the down-time.

Many attempts have been made to reduce make-ready times of lithographic offset printing presses with special emphasis on shortening the washing times. One attempt was to run all washing programs for all printing units of the printing press at the same time. Such a parallel sequence is the current way of controlling the washing operation. It has also been proposed to carry out washing operations while the printing plates are being changed for the next job. Yet for that purpose, it is necessary, for example, to decouple the plate cylinder from the gear train for the individual cylinders of the printing press in order to be able to drive/move it separately to carry out the plate change while a washing operation is carried out on the blanket cylinder, during which the latter is subject to a different sequence of motions.

European Patent Application EP 0 654 350 B1, corresponding to U.S. Pat. No. 6,109,182, proposes to provide variable washing sequence programs depending, for example, on the course of time, on operating parameters of the printing press, or on the degree of contamination. For that purpose, European Patent EP 0 654 350 B1, corresponding to U.S. Pat. No. 6,109,182, relies on washing sequence programs that run in a fully automated way and are completely without any option for operator intervention.

However, those approaches that attempt to optimize make-ready times exclusively by influencing the washing program or the washing times themselves are too short-sighted, for there are many other operations, including manual ones, that a press operator needs to carry out on a printing press during a job change. One of them is to empty the ink fountains, a manual process that requires the ink fountains to be "troweled off" or scraped off. In the process, a foil that had been placed in the ink fountain or ink trough is removed with the residual ink, and the side walls, which laterally delimit the ink fountain and seal it towards the ink fountain roller, are cleaned. The process also involves the reintroduction of a new foil and the refilling of the ink fountain with new ink, a process that may be done by hand using an ink trowel or by inserting a suitable new ink cartridge into an automated refill system that slides back and forth above the ink fountain to fill the latter and to re-meter the ink when necessary.

SUMMARY OF THE INVENTION

It is accordingly an object of the invention to provide a method for cleaning inking units in offset printing presses and an offset printing press, which overcome the hereinafore-mentioned disadvantages of the heretofore-known methods and devices of this general type. More specifically, when there is only one operator working on the machine, the removal of the old ink and the re-introduction of the new ink are naturally done sequentially. Consequently, the invention is intended to reduce make-ready time in such a case, i.e. in a method for cleaning inking units in offset printing presses in which the ink fountains of the individual inking units of the printing units are emptied and refilled with ink sequentially one after the other when a job change occurs.

With the foregoing and other objects in view there is provided, in accordance with the invention, in a method for cleaning inking units in offset printing presses including emptying ink fountains of individual inking units of printing units sequentially one after the other and then refilling the ink fountains with ink, an improvement comprising starting a washing operation for an inking unit immediately after emptying an associated first ink fountain and before emptying remaining ink fountains, starting a washing operation for a further inking unit after emptying a respective further one of the remaining ink fountains, and beginning refilling the first ink fountain while washing operations for one or more of the further inking units are still running.

Due to this measure, the entire process, namely the manual operations of the operator during a job change together with the washing sequences, is optimized. That is because since the washing operations in the individual inking units begin while the remaining inking units have not yet been emptied or troweled off, these sequences will be completed at an earlier point in time. Thus, the operator can start to refill these inking units while washing programs for other inking units are still running. The total duration of the process starting at the beginning of the emptying of the first ink fountain or ink trough and ending once the refilling of the last inking unit is completed, is reduced again as compared to the case in which all of the washing operations in all of the inking units run simultaneously but the washing operation is not started until all of the ink troughs have been emptied.

The cleaning program for the blanket and the impression cylinder of the associated printing unit may be started while the emptying of the first ink trough is begun.

All of the inking units of the printing press may be jointly driven by the main drive of the printing press and may be in motion while the operator works to empty the ink troughs.

Separate coupling in and decoupling of individual inking units, especially for the cleaning process, is not necessary.

In accordance with a particularly advantageous feature in terms of the handling and operation, the completion of the emptying of the ink trough may either be detected automatically and may be used as the initiation of the washing program for the associated inking unit, or a switch or push-button may be provided on the respective inking unit or printing unit within reach of the operator who is emptying the ink trough so that he or she can initiate the washing sequence without having to go to the control console of the printing press. The automatic detection may be done by a sensor that detects the swinging away of the ink trough away from the ink fountain roller, i.e. the movement that the operator implements once the emptying process is completed. Such a sensor, push-button or switch is not only convenient for the operator, but it also reduces make-ready times because the operator does not have to interrupt his or her work to start the washing sequence on the control console. Instead, he or she can immediately start to empty the ink trough on the next printing unit. Moreover, display devices that are connected to the control for controlling the washing of the inking units and display the sequence of the emptying of the inking unit troughs to the operator by corresponding optical signals may be associated with the ink troughs, inking units, or printing units of the printing press.

With the objects of the invention in view, there is concomitantly provided an offset printing press, comprising a plurality of printing units, a plurality of inking units associated with the plurality of printing units, the plurality of inking units being fountain-roller-type inking units or anilox inking units, each including a respective ink fountain roller or a screen roller and a respective ink fountain or chambered doctor blade containing printing ink and configured for movement away from the respective ink fountain roller or screen roller, a control configured to automatically control washing operations in the plurality of inking units of the plurality of printing units, and sensors associated with the ink fountains or the chambered doctor blades for detecting the movement away of the respective ink fountains or chambered doctor blades or a fill level of the ink fountains or switches or push-buttons disposed on the printing units. The sensors, switches or push-buttons are configured to generate corresponding signals associated with the washing operation control and are configured to start a washing program for the plurality of inking units due to the movement away of the respective ink fountains or chambered doctor blades or the fill level or an actuation of the switches or push-buttons.

Other features which are considered as characteristic for the invention are set forth in the appended claims.

Although the invention is illustrated and described herein as embodied in a method for cleaning inking units in lithographic offset printing presses and a lithographic offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
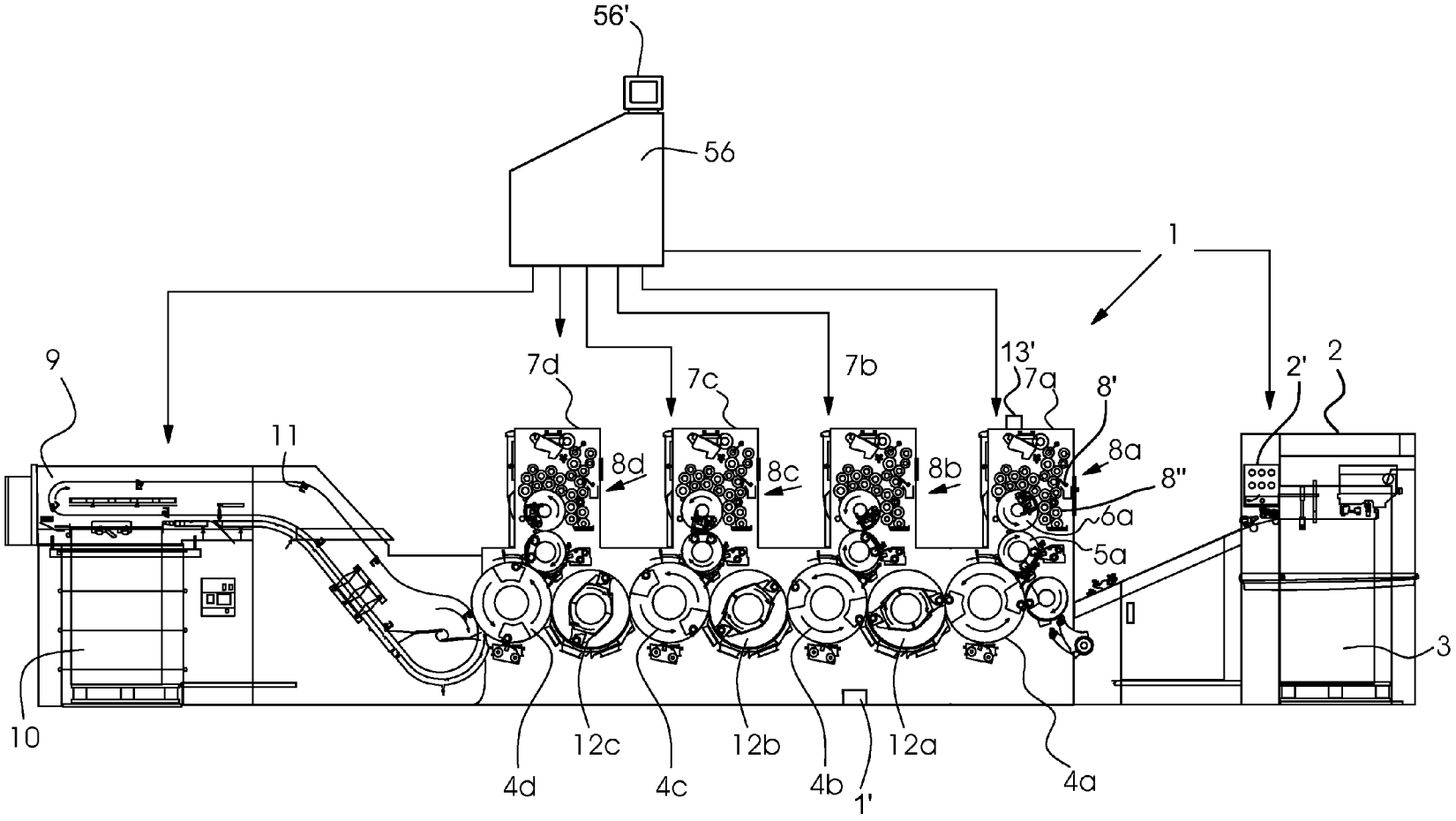
FIG. 1 is a diagrammatic, longitudinal-sectional view of a sheet-fed lithographic offset printing press with four printing units.

Referring now to the figures of the drawings in detail and first, particularly, to FIG. 1 thereof, there is seen a lithographic offset printing press 1 having an in-line construction and including a feeder 2, which contains a pile 3 of unprinted paper, and four printing units 7*a-d* for the four process colors black, yellow, magenta and cyan. Transfer drums 12*a-c* are provided between the printing units 7*b-d* to transfer the sheets to be printed to respective impression cylinders 4*b-d* of the printing units. The printing unit 7*a* also has an impression cylinder 4*a*. The fourth printing unit 7*d* is followed by a delivery 9 of the printing press. The delivery 9 includes gripper bars 11 revolving through the use of a chain guide. These grippers bars 11 receive the printed sheet and transport it to a sheet pile 10 on which it is deposited.

Each of the four printing units 7*a-d* includes, in addition to the impression cylinder 4*a-d*, a blanket cylinder 5*a* and a printing forme cylinder 6*a* carrying a respective printing plate. Ink is provided to the printing plates by inking units 8*a-d* driven by a main drive 1' of the printing press 1. One of the inking units will be described in more detail below.

The functions performed in the printing units 7*a-d*, in the feeder 2 and in the delivery 9 are operated, controlled and monitored on a machine control or control unit 56 having a display device 56'.

Figure 2:
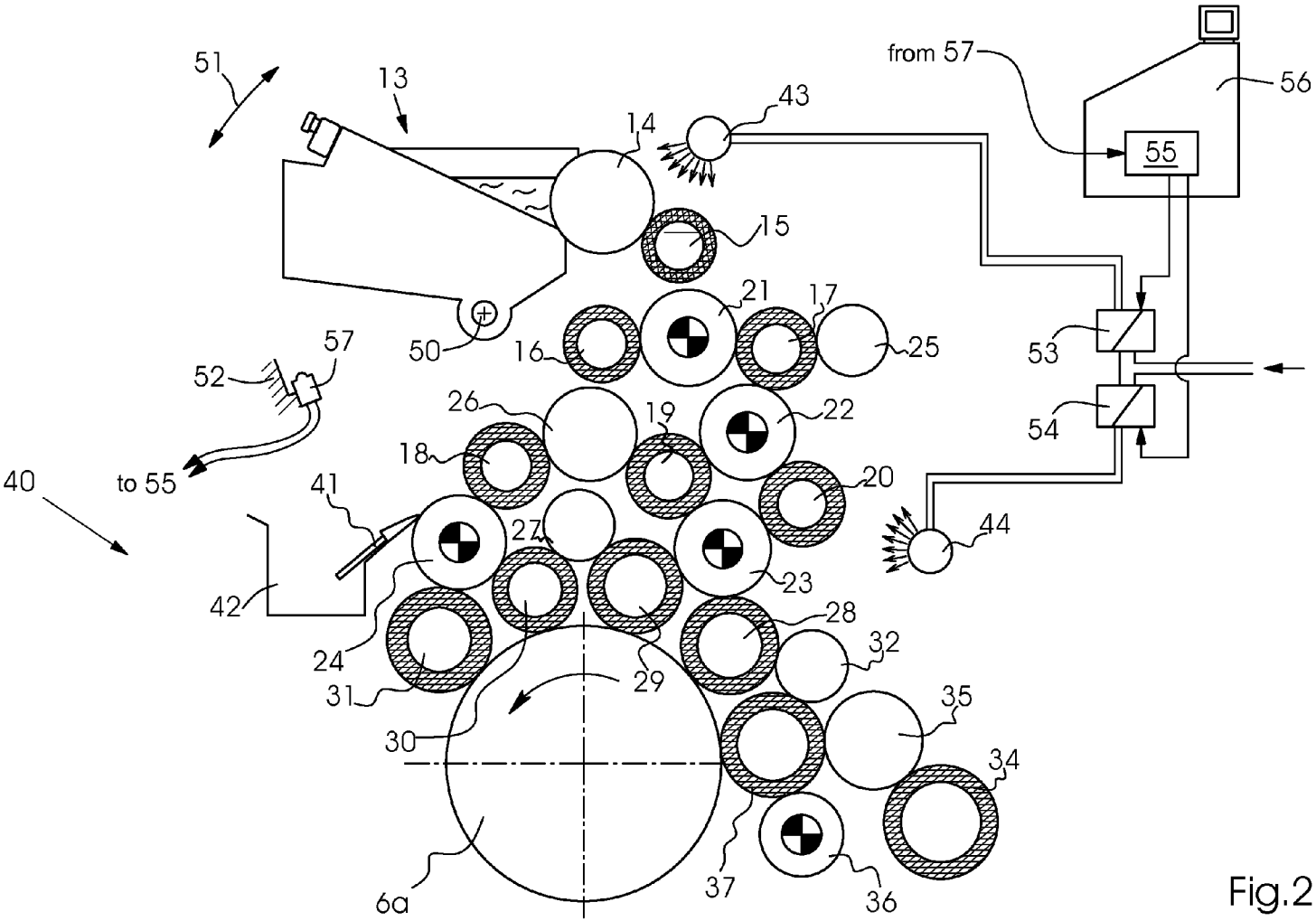
FIG. 2 is an enlarged, side-elevational view of an inking unit of the sheet-fed lithographic offset printing press shown in FIG. 1, which is modified in accordance with the invention.

The inking unit shown in FIG. 2 includes an ink trough or fountain 13, an ink fountain roller 14, four ink applicator rollers 28, 29, 30 and 31 for inking the printing plate disposed on the cylinder 6*a* and a plurality of further rollers 15 to 27, which receive ink from the ink fountain roller 14, distribute and smoothen it and feed it to the applicator rollers. Reference numeral 15 indicates a vibrator roller, which cyclically pivots between the ink fountain roller 14 and the roller 21. The rollers 21, 22, 23 and 24 are distributor rollers that oscillate in the lateral direction, with the distributor rollers 23 and 24 being cooled rollers. Like the four ink applicator rollers 28 to 31, the ink fountain roller 15 and the rollers 16, 17, 18, 19, 20 have a rubber jacket, whereas a bridge roller 32, which is disposed between a dampening solution applicator roller 37 and the first ink applicator roller 28, as well as the rollers 27, 26 and 25, are steel rollers.

A trough 42 including a scraper or washing blade 41 that can be engaged with the roller 24 is provided to wash the inking unit. Moreover, spraying tubes 43 and 44 are provided to spray washing liquids into the inking unit in accordance with commands output to two valves 53 and 54 by the control unit.

As is indicated by an arrow 51, the ink trough or fountain 13 is pivotable about an axis 50. Having been emptied, the ink trough or fountain 13 can be removed from the ink fountain roller 14 and locked against a stop 52. An end switch 57 disposed on the stop detects the completion of the disengaging movement of the ink fountain and emits a corresponding signal to a portion 55 of the control unit 56 that is responsible for the washing operations. Sensors 13' shown in FIG. 1 associated with the ink fountains 13 detect movement away of the ink fountains 13 or a fill level of the ink fountains 13.

Figures 3, 4:
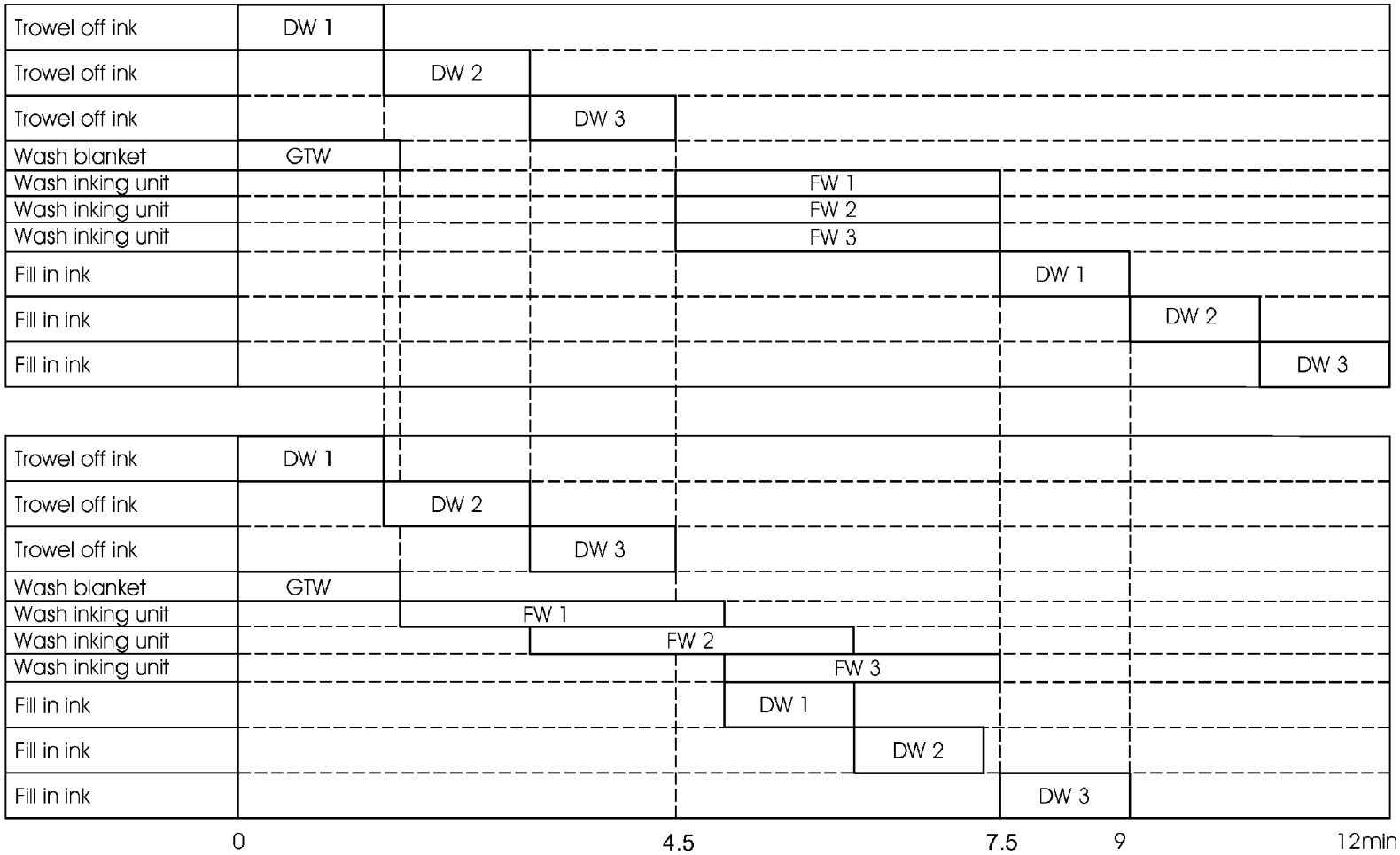
Fig. 3 PRIOR ART
FIG. 3 is a first flow chart representing a prior art time sequence of operations carried out on an inking unit during a job change.
FIG. 4 is a second flow chart representing a time sequence of operations carried out in accordance with the invention on a printing unit during a job change.

As is seen in FIG. 3, in the method according to the prior art, the press operator carries out the following operations for a job change. In the illustrated example, it is assumed that three of the four inking units need to be cleaned whereas the ink in the fourth inking unit, for example black ink, may remain.

A washing operation for the blanket cylinders and potentially for the impression cylinders is initiated in all of the printing units that were in use for the job that has just been completed. This is symbolized by a bar marked GTW. As the washing operation is started on these cylinders, the operator at the same time starts to trowel off the ink in the ink fountain of the first printing unit 1. The time that he or she needs for this operation is indicated by a bar marked DW 1. When he or she is finished, the operator swings the ink fountain away from the ink fountain roller and moves on to the next printing unit 2 to continue the emptying process. This process is symbolized by a bar marked DW 2. Subsequently, the same process is implemented for the third printing unit 3 symbolized by a bar marked DW 3.

Subsequently, the operator goes to the control console to start the washing operations for the inking units in printing units 1 to 3, which are then carried out simultaneously as indicated by three bars marked FW 1 to FW 3 illustrated on top of each other.

As soon as the washing operations are completed, the operator reintroduces ink into the printing units 1 to 3 (symbolized by bars DW 1 to DW 3). Since the inking unit washing operations FW take approximately three minutes, this means that the operator needs to wait before he or she can start to refill the ink fountains.

The sequence of operations proposed by the invention is illustrated in the FIG. 4. The method of the invention likewise starts with a washing operation on the blanket and other cylinders outside the inking unit as soon as the previous print job is completed. Again, the operator simultaneously starts to scrape off the ink from printing units 1 to 3 (as symbolized by bars DW 1 to DW 3).

However, as soon as he or she has emptied the first ink fountain and swung it away from the ink fountain roller, the swinging motion operates the switch 57, which signals to the inking unit washing control 55 that the ink trough or fountain 13 is empty. Push-buttons 2' on the feeder 2 may also be used to control the washing operation. The control portion 55 in the control unit or console 56 of the printing press then starts to initiate the inking unit washing operation FW 1 for the first inking unit as soon as the washing of the blanket cylinder and impression cylinder is completed. While this operation indicated by the symbol FW 1 is running, the operator empties the ink fountains of the inking units in the further printing unit 2 to 3. As soon as the respective ink trough or fountain 13 is swung away, the control initiates the inking unit washing sequence for the associated inking unit.

Once the washing sequence FW 1 for the first inking unit is completed, the operator can immediately start to refill the first inking unit DW 1. Subsequently, he or she can refill the ink fountains of the inking units in printing units 2 and 3 as soon as the washing operation for the respective further inking units is completed.

As is indicated by FIG. 4, the make-ready time required for cleaning the inking units is thus reduced on the whole from the twelve minutes of the prior art to approximately nine minutes, although the washing operations for the inking units in the printing units 1 to 3 do not run in parallel, but rather sequentially in a partly overlapping way. The reduction is basically due to the fact that there is less waiting time for the operator. In addition, it is not necessary to divide the printing press gear train that drives the various cylinders including the blanket cylinder, the plate cylinder and the inking unit, since all of the washing operations can be carried out while the machine continues to run at a reduced speed suitable for the washing operations.

The description given above refers to a printing press with a conventional inking unit including an ink fountain and an ink fountain roller. However, the sequences described above may likewise be implemented in the same way in lithographic offset printing presses that include so-called short inking units. In this case, a chambered doctor blade 8' is used instead of the ink fountain, and instead of an ink fountain roller, these inking units include a screen roller 8" that is engaged with the chambered doctor blade 8' during printing. The chambered doctor blade 8' is swung away from the screen roller 8" for cleaning purposes.

The invention claimed is:

1. In a method for cleaning inking units in offset printing presses including emptying ink fountains of individual inking units of printing units sequentially one after the other and then refilling the ink fountains with ink, the improvement comprising the following steps:

starting a washing operation for an inking unit immediately after emptying an associated first ink fountain and before emptying remaining ink fountains;

starting a washing operation for a further inking unit after emptying a respective further one of the remaining ink fountains; and beginning refilling the first ink fountain while washing operations for one or more of the further inking units are still running.

2. The method according to claim 1, which further comprises always starting refilling of a next one of the further ink fountains as soon as a washing program for a respective associated inking unit is completed.

3. The method according to claim 1, which further comprises starting a cleaning program for a blanket or an impression cylinder of a printing unit while an associated first ink fountain is still being emptied.

4. The method according to claim 1, which further comprises jointly driving the inking units of the printing press with a main drive of the printing press and keeping the inking units in motion during the emptying of at least one of the further ink fountains.

5. The method according to claim 1, which further comprises moving a respective emptied ink fountain away from an ink fountain roller and generating a signal in a course of the movement to start a washing operation for an associated inking unit.

* * * * *